US006095166A

United States Patent [19]

Yoshimura et al.

[11] Patent Number: 6,095,166

[45] Date of Patent: Aug. 1, 2000

[54] CLEANING APPARATUS FOR COOLING WATER PASSAGE OF AN OUTBOARD MOTOR

[75] Inventors: Naohisa Yoshimura; Kenichi Fujii, both of Hamamatsu; Fumio Matsui, Shizuoka-Ken, all of Japan

[73] Assignee: Suzuki Kabushiki Kaisha, Hamamatsu, Japan

[21] Appl. No.: 09/145,459

[22] Filed: Sep. 2, 1998

[30] Foreign Application Priority Data

Sep. 11, 1997 [JP] Japan ..... 9-247235

[51] Int. Cl.[7] ..... B08B 9/00

[52] U.S. Cl. ..... 134/169 A; 134/166 R; 134/166 C; 134/169 C

[58] Field of Search ..... 134/166 R, 167 R, 134/169 A, 166 C, 169 C; 123/198 A

[56] References Cited

U.S. PATENT DOCUMENTS

| | | | |
|---|---|---|---|
| 1,772,011 | 8/1930 | Malo | 123/198 A |
| 3,931,828 | 1/1976 | Lawler | 134/167 R |
| 4,052,953 | 10/1977 | Patel | 134/167 R |
| 4,306,520 | 12/1981 | Slaton | 123/25 A |
| 4,589,851 | 5/1986 | Karls | 440/88 |
| 5,474,098 | 12/1995 | Grigorian et al. | 134/169 A |
| 5,562,510 | 10/1996 | Suzuki et al. | 440/89 |
| 5,698,043 | 12/1997 | Acevedo | 134/10 |
| 5,820,427 | 10/1998 | Valdes | 440/88 |

FOREIGN PATENT DOCUMENTS

| | | |
|---|---|---|
| 3-37322 | 2/1991 | Japan . |
| 269345 | 10/1995 | Japan . |

*Primary Examiner*—Frankie L. Stinson
*Attorney, Agent, or Firm*—Finnegan, Henderson, Farabow, Garrett & Dunner, L.L.P.

[57] ABSTRACT

An outboard motor is provided with a cleaning apparatus for cleaning a cooling water passage, in which the cooling water passage is formed and an engine is covered by an engine cover, the cleaning apparatus including a connection device to which one end of a cleaning water tube, which is connected at another end thereof to the cooling water passage of the engine, is connected and a cleaning water hose is connectable to the connection device from an external side thereof. The connection device comprises a grommet mounted to the engine cover and a connector assembly mounted to the grommet. The connector assembly has a double-tube structure having an inside connecting portion and an outside connecting portion, the inside connecting portion having a union structure to which a city hose or garden hose is connected and the outside connecting portion having an outer peripheral portion to which a screw portion is formed.

21 Claims, 6 Drawing Sheets

CLEANING APPARATUS FOR COOLING WATER PASSAGE OF AN OUTBOARD MOTOR

BACKGROUND OF THE INVENTION

The present invention relates to a cleaning apparatus for a cooling water passage of an outboard motor having an improved structure.

In general, an engine of an outboard motor is cooled by taking a cooling water from an outside of the outboard motor, and accordingly, in a case where a sea water is used as such cooling water, a salt component contained in the sea water may stick to a cooling water passage of the outboard motor such as water jacket of the engine, which will result in corrosion to that portion. In order to eliminate such defect, it is necessary to periodically clean the cooling water passage with a pure water, and for this purpose, the outboard motor is provided with a cleaning apparatus for cleaning the cooling water passage, which is generally called as a flush system.

In such flush system, a cleaning water tube is connected at one end to the cooling water passage, another end of the cleaning water tube is connected to, for example, a connection portion formed to an engine cover, and a cooling water hose for supplying a cleaning water is connected to the connection portion from the outside thereof.

Such structure is, for example, disclosed in Japanese Patent Publication No. HEI 3-37322 (37322/1991), in which a connection portion is formed to an inner portion of an outside end of an inner passage of a conduit extending from an engine block, and the connection portion is formed with a screw thread to be coupled to a mail connector (standard size article) of a garden hose as a cleaning water hose.

Furthermore, Japanese Patent Laid-open (KOKAI) Publication No. HEI 7-269345 discloses a technology such that a hose is connected to the cooling water passage, a front end of the hose extends outside the outboard motor, and the front end thereof is formed with a connection portion to be coupled to a mail connector (standard size article) of a garden hose.

As mentioned above, in the described prior art, it is necessary to use the connector of the standard size article to be coupled to the connection portion.

Furthermore, in another prior art, there is also provided a structure in which an adapter is coupled to a cooling water passage and a general hose for city water is connected to the adapter or in which an ear-muffler-type adapter is applied to a cooling water intake port formed to a gear case and a general hose for city water is connected to the adapter.

However, with the structure using the connector of the standard article, it is necessary to use an adapter to be connected to a general hose for city water, thus being inconvenient.

Furthermore, the structure in which the front end of the connection hose is extended outside the outboard motor will not give a good outer appearance.

Still furthermore, when a cleaning water is supplied through the cooling water intake port, it is necessary to start the engine to drive a water pump, thus being inconvenient.

SUMMARY OF THE INVENTION

An object of the present invention is to substantially eliminate the inconveniences or problems encountered in the prior art described above and to provide a cleaning apparatus for a cooling water passage of an outboard motor capable of connecting a general hose for city water, without using any adapter, to a connection portion to which a connector of a standard size article is connected.

This and other objects can be achieved according to the present invention by providing a cleaning apparatus for cleaning a cooling water passage of an outboard motor equipped with an engine in which the cooling water passage is formed and which is covered by an engine cover, the cleaning apparatus including a connection device to which one end of a cleaning water tube, which is connected at another end thereof to the cooling water passage of the engine, is connected and a cleaning water hose is connectable to the connection device from an external side thereof, the connection device comprising:

a grommet mounted to the engine cover; and a connector assembly mounted to the grommet, the connector assembly having a double-tube structure having an inside connecting portion and an outside connecting portion, the inside connecting portion having a union structure to which a city hose is connectable and the outside connecting portion having an outer peripheral portion to which a screw thread portion is formed.

In preferred embodiments in the above aspect, the engine cover is formed with a mounting hole to which the connection device is mounted, and the grommet has a cylindrical structure having openings at both end portions thereof, one of the openings being formed with an outer peripheral edge to which a peripheral groove is formed to be engaged with a peripheral edge of the mounting hole and another one of the openings being formed with an inner peripheral edge, and the connector assembly is formed with a flange portion which is fitted to the inner peripheral edge. The engine cover is provided with a curved portion at which the grommet is mounted.

The connector assembly is provided with a projection extending inside the engine to which the cleaning water tube is connected. The connector assembly further comprises a cap member which is detachably applied to the one of the openings of the grommet so as to close an end opening of the connector assembly.

A projection is formed to an inner surface of the engine cover at a portion below the location of the connector assembly to which the cleaning water tube reaches.

The connector assembly further comprises an extension member and the outside connecting portion of the connector assembly is engaged with a garden hose of a size of U.S. standard through an engagement with the screw thread portion formed to the outside connecting portion.

According to the present invention of the features mentioned above, the grommet to be mounted to the connection device mounting hole is formed so as to provide the cylindrical structure. The one opening of the grommet is formed, at its outer peripheral edge, with the peripheral groove to be engaged with the peripheral edge portion of the hole and the other opening of the grommet is formed, at its inner peripheral edge, with the peripheral groove fitted to the flange portion of the connector, so that the workability at the assembling time can be improved and the improved outer appearance can be also provided.

Further, when the cleaning water hose or garden hose of U.S. standard is assembled, although a twisting force is applied to the connector and then to the grommet, the grommet is disposed to the connecting device mounted to the curved portion of the rear side of the lower engine cover, so that the grommet and the connector are not rotated together when the hose are assembled in the twisting manner.

Furthermore, in the U.S. market, the garden hose is generally used, but in another market, the general city hose is used. Accordingly, the connector is formed so as to provide a double cylindrical structure having inside connection portion and the outside connecting portion, in which the inside connecting portion has a union structure which is capable of being connected to the city hose and the outside connecting portion is formed with the male screw thread portion to which the garden connector is connectable, whereby a plurality of hoses can be connected in a selected manner to one connector, thus being convenient and economical.

The nature and further characteristic features of the present invention will be made more clear from the following descriptions made with reference to the accompanying drawings.

DESCRIPTION OF THE PREFERRED EMBODIMENT

Figure 1:
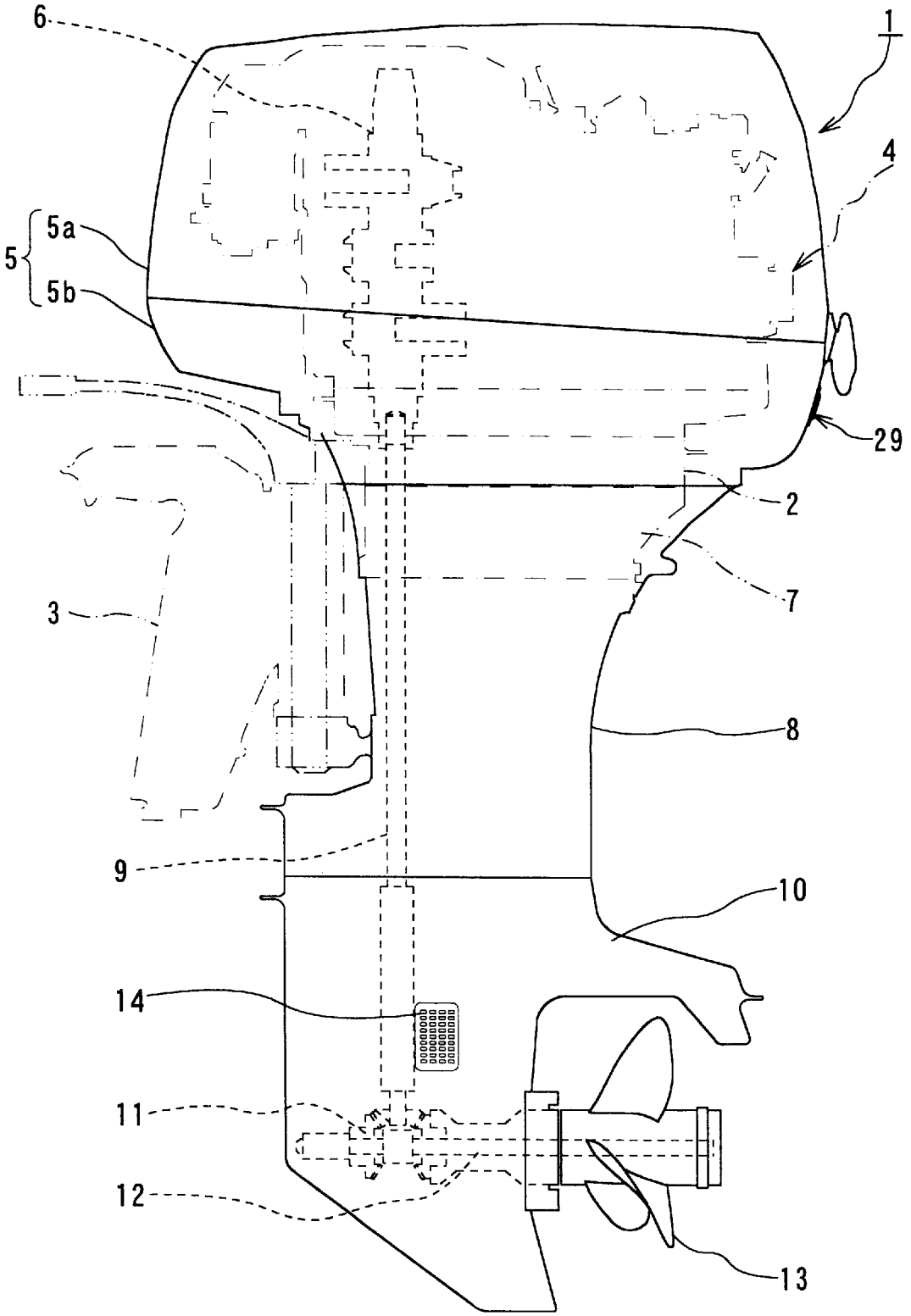
FIG. 1 is a left side view of an outboard motor, in a state mounted to a hull, for example, to which one embodiment of a cleaning device for a cooling water is applicable.

With reference to FIG. 1, an outboard motor 1 is provided with an engine holder 2 and is mounted to a hull, not shown, by means of bracket 3 attached to the engine holder 2. An engine 4 is mounted to an upper portion of the engine holder 2 and is covered by an engine cover 5, which has a structure dividable into upper and lower cover sections 5*a* and 5*b* in such a manner that engine holder 2 and the lower portion of the engine 4 is covered by the lower cover section 5*b* and the upper portion of the engine 4 is covered by the upper cover section 5*a*.

A crank shaft 6 is arranged in the engine in a perpendicular attitude, and a drive shaft housing 8 is disposed below the engine holder 2 by way of an oil pan 7. A drive shaft 9, having one end connected to the lower end of the crank shaft 6, is housed in the drive shaft housing 8 so as to extend downward. The drive shaft 9 is operatively connected to a propeller 13 so as to rotate the same through a bevel gear 11 housed in a gear case 10 and a propeller shaft 12.

The engine 4 of the outboard motor 1 generally has a water-cool-type structure, which is cooled by a cooling water, for example, sea water, taken in the inside of the engine through an intake port 14 formed to the gear case 10.

Figure 2:
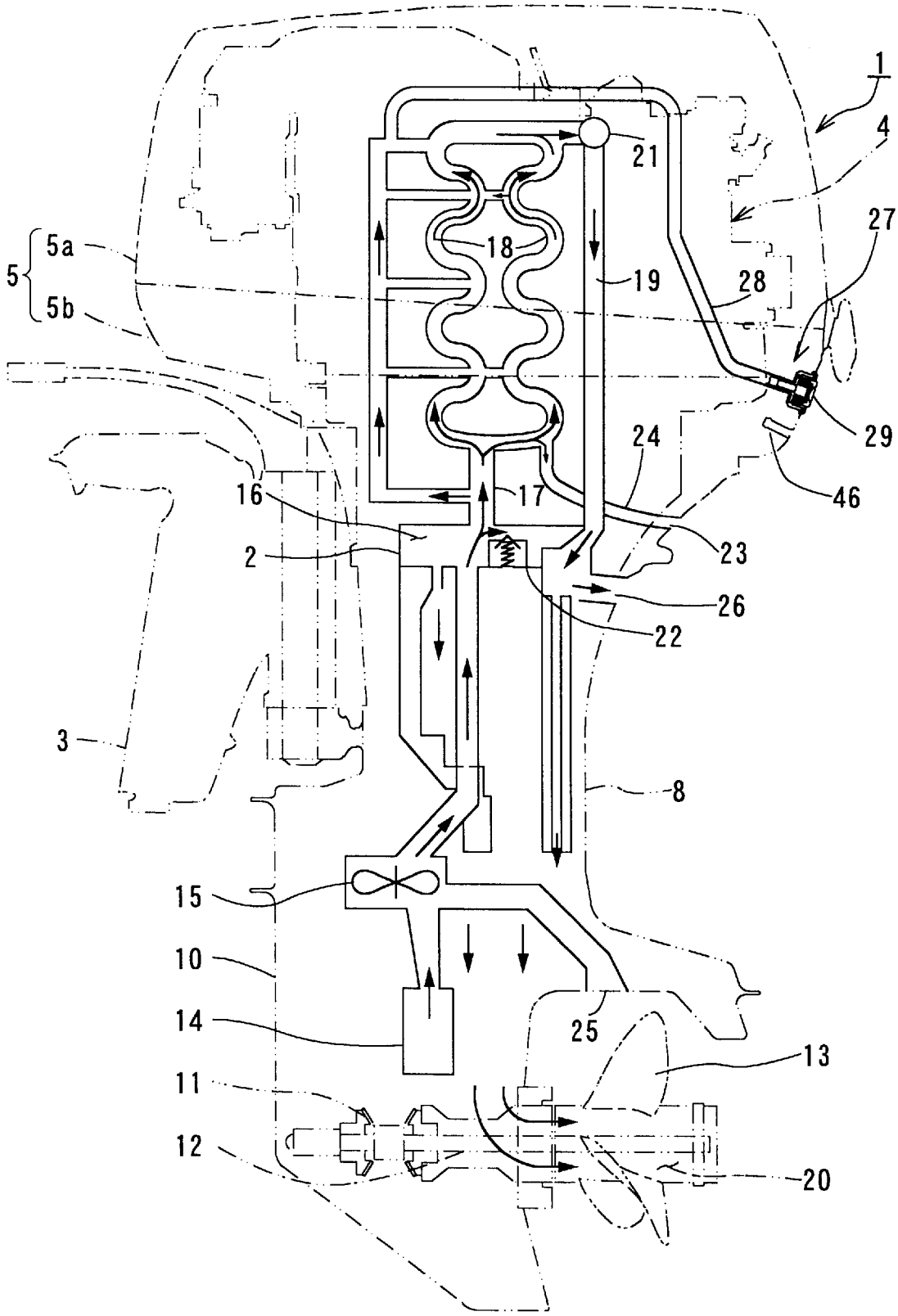
FIG. 2 is a view showing a cooling system of the outboard motor of FIG. 1.

FIG. 2 is a view showing a cooling system of the outboard motor 1, in which the flow of the cooling water is shown by arrows.

The cooling water is taken by the operation of a water pump 15, which is driven through a drive shaft 9, disposed above the gear case 10 through the intake port 14 and guided into a cooling water reservoir 16 formed inside the engine holder 2. The cooling water is then guided to a water-feed pipe 17 as a cooling water passage and, thereafter, to a water jacket 18 as another water passage formed around the engine 4, thus cooling the engine 4. The cooling water after cooling the engine 4 is guided into the drive shaft housing 8 through a discharge pipe 19 as a further cooling water passage and then discharged outside, for example, into a sea water, together with an exhaust gas through a discharge passage formed around the propeller shaft 12.

The water jacket 18 is connected to the discharge pipe 19 through a connection portion to which a thermostat 21 is provided so as to be closed till the temperature of the cooling water reaches predetermined temperature to thereby prevent the engine 4 from being excessively cooled. When the thermostat 21 is closed, the hydraulic pressure of the cooling water is increased and then escapes into the drive shaft housing 8 through a pressure valve 22 provided for the engine holder 2. Further, an inspection port 23 is formed to a rear portion of the outboard motor 1 for inspecting quality of the cooling water, and the inspection port 23 and the water jacket 18 is connected through a tube 24. In FIG. 2, reference numeral 25 denotes an auxiliary water intake port and 26 denotes an auxiliary discharge port.

In the case where the sea water is used as cooling water for cooling the engine of the outboard motor, there is a fear such that salt component contained in the sea water sticks to the cooling water passage such as water jacket 18 which will result in corrosion to that portion, and therefore, it is necessary to periodically wash and clean the cooling water passages 17 to 19 by fresh water (city water). For this purpose, the outboard motor 1 is provided with a cooling water passage cleaning device 27, which includes a connection device 29 mounted to a lower cover 5*b*. A cleaning water tube 28 having one end connected to the cooling water passages 17 to 19 is connected, at its another end to the connection device 29, to which cleaning water hose is connected, as shown in detail in FIG. 3.

Figure 3:
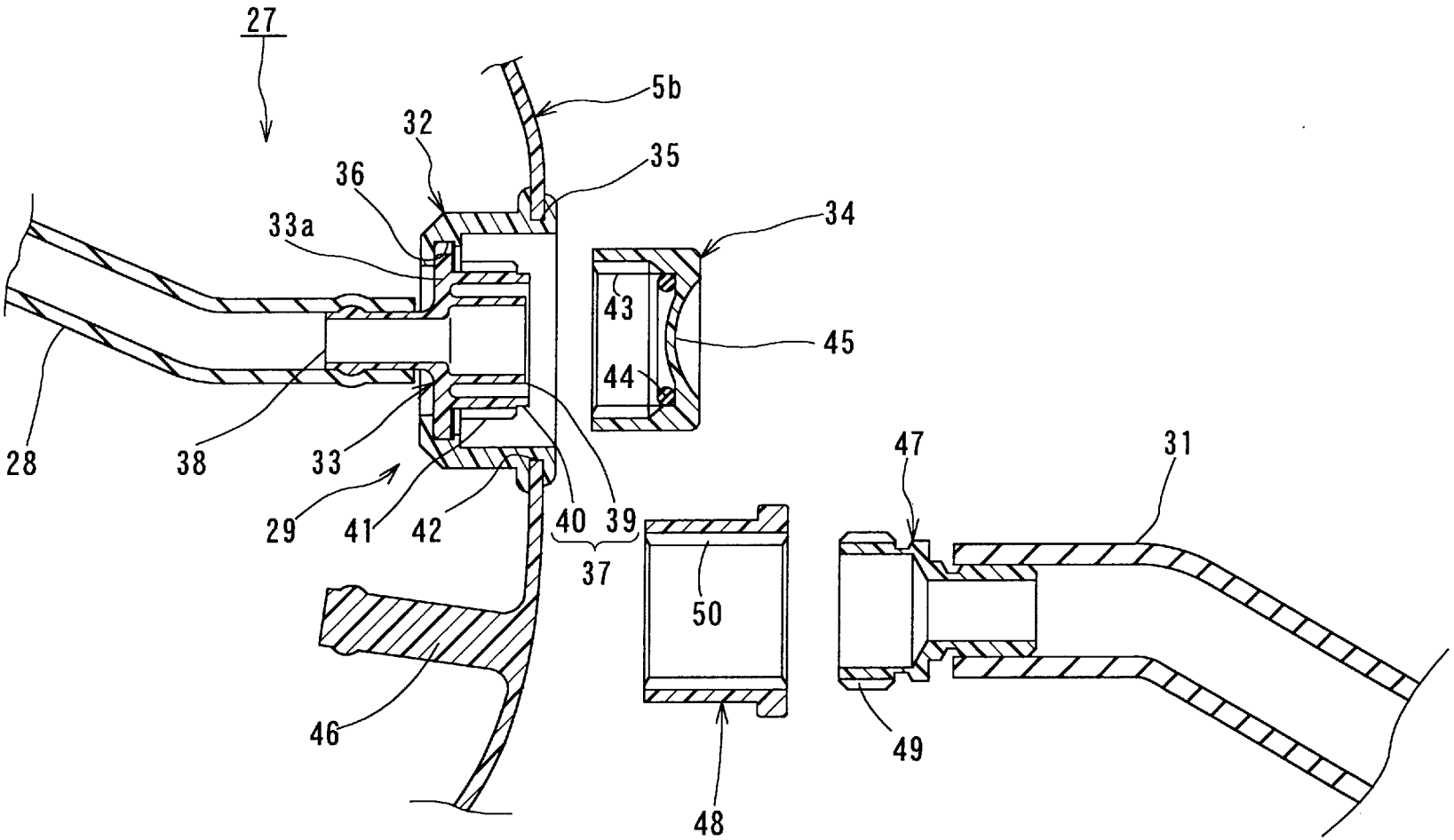
FIG. 3 is a sectional view, in an enlarged scale, of a connection device of the cleaning apparatus.

FIG. 3 is an enlarged sectional view of the connection device 29 mentioned above.

With reference to FIG. 3, the connection device 29 is composed of a grommet 32, a connector (connector assembly) 33 and a cap 34. The grommet 32 has a cylindrical structure formed of a resin, for example, and having one open end, right side as viewed, having an outer peripheral edge to which a peripheral groove 35 is formed and another open end, left side as viewed, having an inner peripheral edge to which a peripheral groove 36 is also formed.

The connector 33 is also formed of a resin, for example, to which a coupling portion 37 is integrally formed at its one end, right side as viewed, through a disc-shaped flange portion 33*a* and a union 38, to which the end portion of the cleaning water tube 28 is connected, is also integrally formed at its another end. The coupling portion 37 has a double-tube structure composed of an inner and outer coupling or connecting sections 39 and 40, in which the inner coupling or connecting section 39 is formed in shape of union to which a city water hose 30 is connected and a male screw portion (thread) 41 is formed to an outer peripheral surface of the outer coupling section 40.

The engine lower cover 5*b* has a curved rear portion, to which a hole 42 for mounting the connection device 29 is formed, and the grommet 32 is mounted to the hole 42 so that an edge portion of the hole 42 is fitted to the outer peripheral groove 35 of the grommet 32. The flange portion 33*a* of the connector 33 is fitted to the inner peripheral groove of the grommet 32. Further, cutouts, for preventing rotation, are formed to portions of the fitting portions between the grommet 32 and the hole 42.

Figure 4:
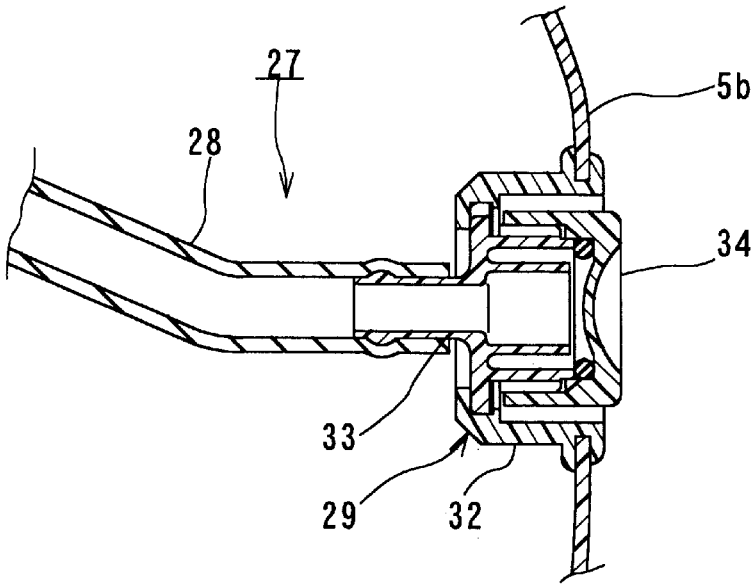
FIG. 4 is a sectional view, in an enlarged scale, of a connection device at which a cap is coupled to a connector.

The coupling portion 37 of the connector 33 is closed by the cap 34 having a bottomed cylindrical structure and the cylindrical structure has an inner edge portion to which a female screw portion (thread) 43 is formed so as to be engaged with the male screw portion 41 formed to the outer peripheral surface of the outer coupling section 40. An O-ring 44, or alternatively referred to as sealing element 44 is disposed to an inside bottom portion of the cap 34, and a groove 45 is also formed to an outside bottom portion of the cap 34 so that, for example, a coin is fitted to the groove 45 to attach or remove the cap 34. The cap 34 has a size such that its bottom portion does not largely project outward from the surface of the lower cover 5*b* when fitted to the connector 33, as shown in FIG. 4.

Figure 5:
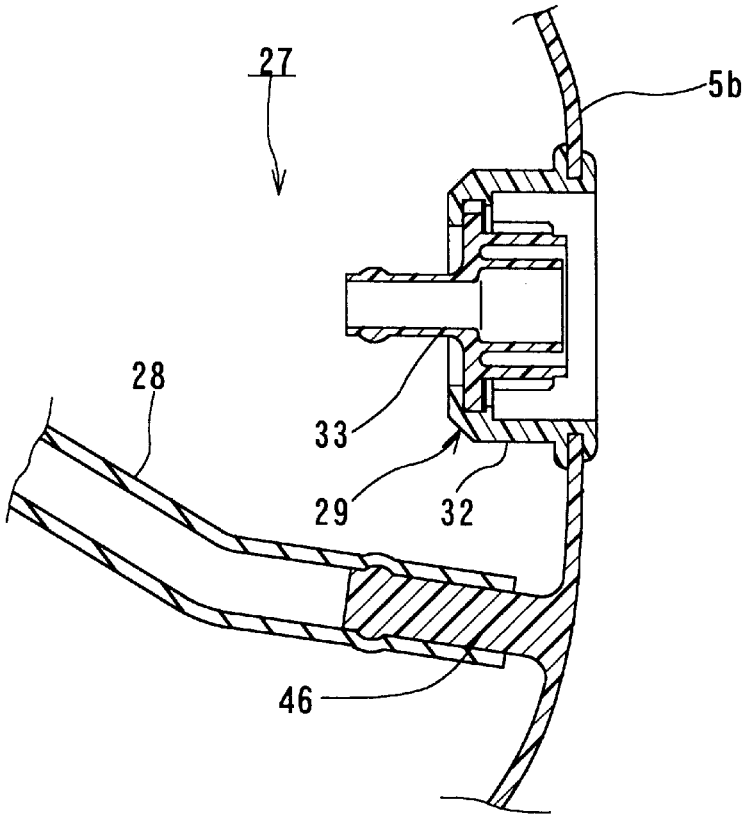
FIG. 5 is a sectional view, in an enlarged scale, of a connection device at which a cleaning water tube is fitted to a projection.

As shown in FIG. 3, a projection 46 is integrally formed to the inner surface of the lower cover 5*b* at a portion in the vicinity of the connection device 29 where the end portion of the cleaning water tube 28 reaches. The projection 46 serves in substitution for the cap 34. That is, when the cap 34 is lost by any reason, if the engine is driven, a part of the cooling water is flowed outward through the connector 33 of the connection member 29, limiting the use of the engine 4. In such case, even if the cap 34 is not provided by any reason, the end portion of the tube 28 is firmly fitted to the projection 46, as shown in FIG. 5, to prevent the cooling water from flowing out and the engine 4 is operated with no limitation in use.

As shown in FIG. 3, the connection device 29 is provided with a connector 47 for a garden hose 31 of U.S. standard as an optional member and also provided with an extension member 48 for connecting the garden hose connector 47 and the connector 33. The extension member 48 has a cylindrical structure having an inner peripheral surface formed with a female screw portion (thread) 50 engageable with the male screw portion 41 of the outer connecting portion 40 of the connector 33 and the male screw 49 formed to the outer peripheral surface of the garden hose connector 47.

Figure 6:
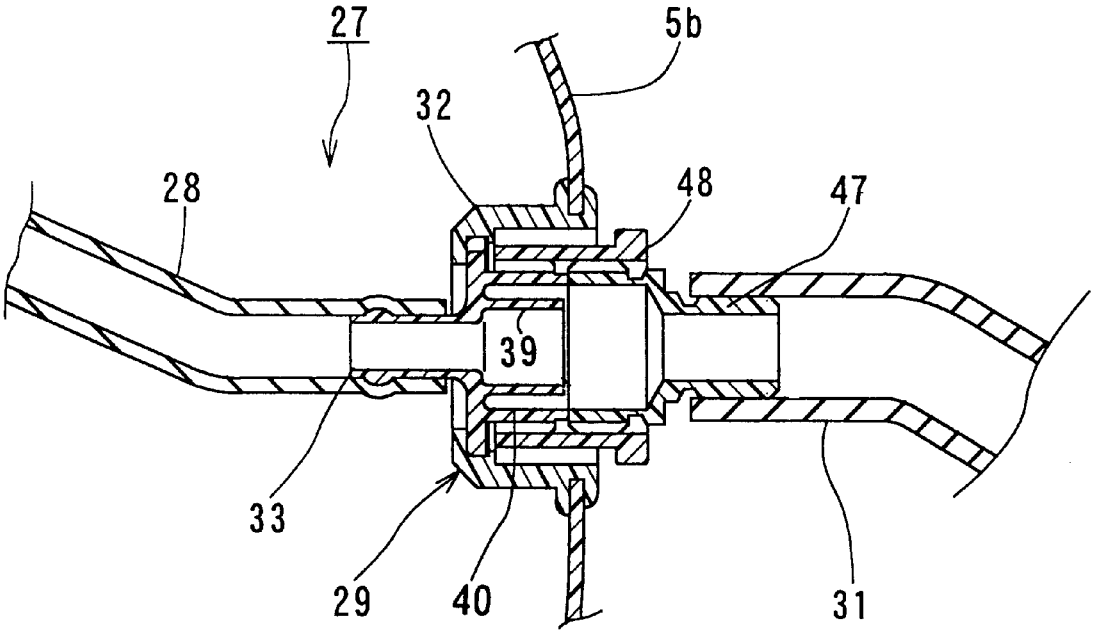
FIG. 6 is a sectional view, in an enlarged scale, of a connection device at which a garden hose is connected to a connector.
Figure 7:
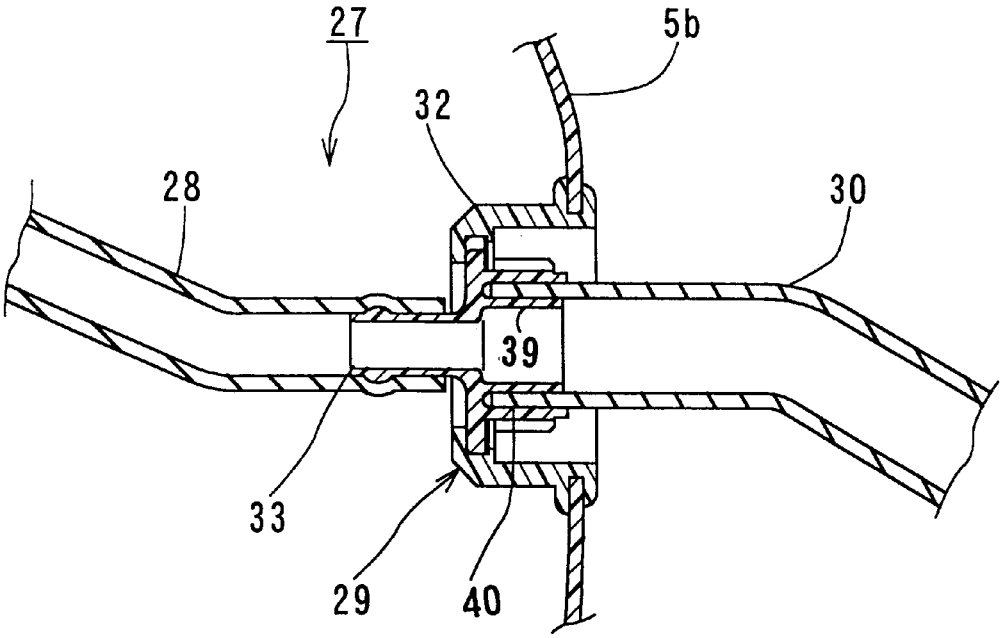
FIG. 7 is a sectional view, in an enlarged scale, of a connection device at which a general city water hose is connected to a connector.

The connection between the connector 33 of the connection device 29 and the connector 47 of the garden hose will be made for example as shown in FIG. 6, in which the extension member 48 is connected to one connector 33, in the illustrated embodiment, while being preliminarily connected to the other connector 47. Further, in a case where a general city hose 30 is connected to the connector 33 of the connection device 29, the end portion of the city hose 30 will be connected to the inside coupling portion 39 of the connector 33 as shown in FIG. 7.

Figure 8:
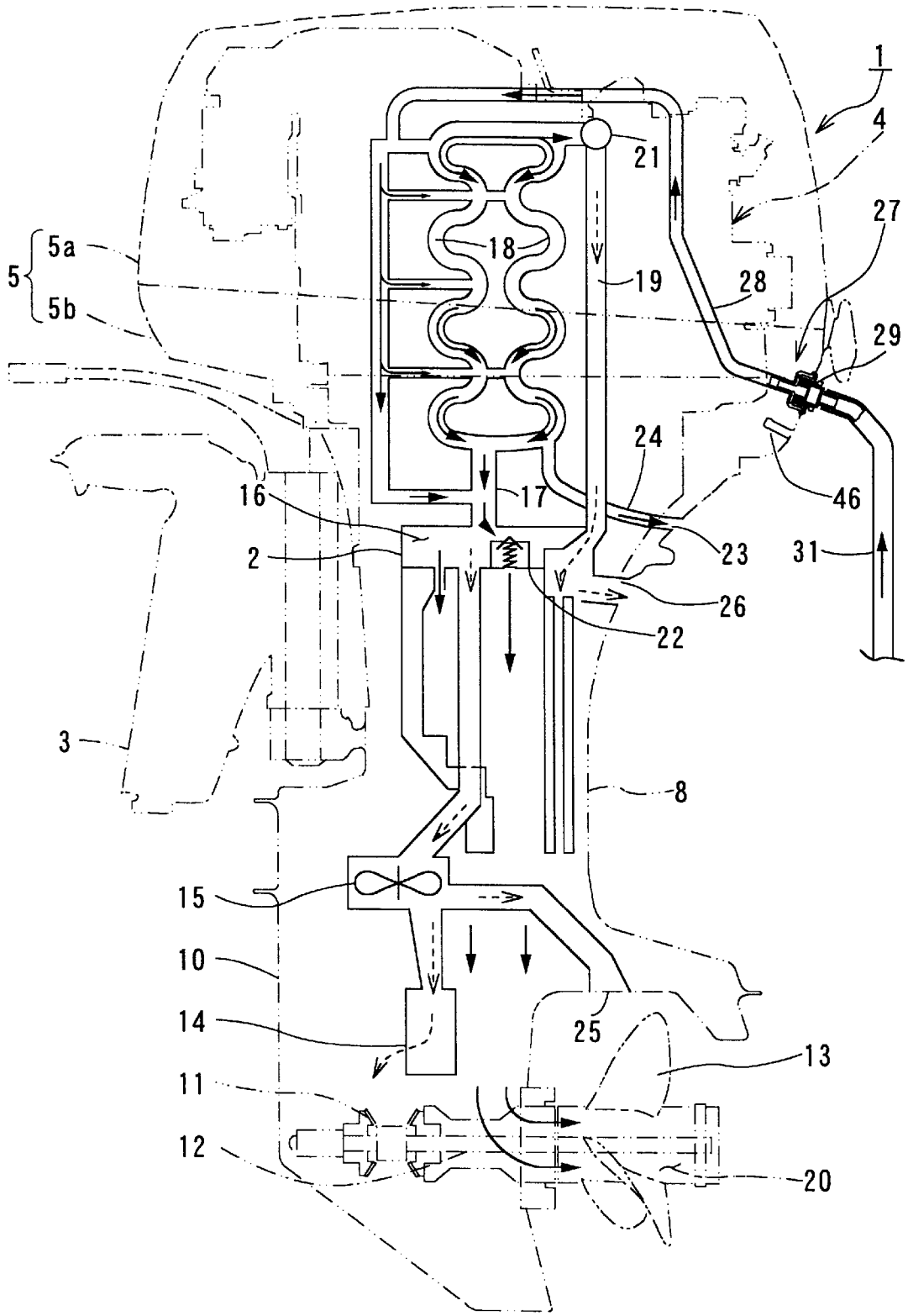
FIG. 8 is a view showing a cleaning system for a cooling water passage of an outboard motor.

FIG. 8 is a view showing the cooling water passage cleaning system of the outboard motor 1, in which the flow of the cleaning water is shown by arrows, and the solid arrows designate the main flow of the cleaning water and broken arrows designate the sub-flow (small flow) of the cleaning water.

With reference to FIG. 8, the cleaning water guided through the cleaning water hose (garden hose 31 or city hose 30) connected to the connector 33 of the connection device 29 passes through the cleaning water tube 28 and is then guided to the water jacket 18 as the part of the cooling water passage, the water supply tube 17 and the water discharge tube 19 to clean these portions by the water pressure thereof, and thereafter, the cleaning water is guided to the cooling water reservoir 16 formed in the engine holder 2. The pressure valve 22 is opened by the pressure of the cleaning water, which is then guided into the drive shaft housing 8, and one portion of the cleaning water is discharged through the water pump 15 and the intake port 14.

According to the present invention, the grommet 32 to be mounted to the connection device mounting hole 42 formed to the rear portion of the lower cover 5*b* is formed so as to provide the cylindrical structure. The one opening of the grommet is formed, at its outer peripheral edge, with the peripheral groove 35 fitted to the hole 42 and the other opening of the grommet is formed, at its inner peripheral edge, with the peripheral groove 36 fitted to the flange portion 33*a* of the connector 33, so that the workability at the assembling time can be improved and the improved outer appearance can be also provided.

Further, when the cleaning water hose 30 (31) is assembled, although a twisting force is applied to the connector 33 and then to the grommet 32, the grommet 32 is disposed to the connection device 29 mounted to the curved portion of the rear side of the lower cover 5*b*, so that the grommet 32 and the connecter 33 are not rotated together when the hose 30 (31) are assembled in the twisting manner.

Furthermore, in the U.S. market, the garden hose 31 is generally used, but in another market, the general city hose 30 is used. Accordingly, the connector 33 is formed so as to provide a double cylindrical structure having inside connection portion 39 and the outside connecting portion 40, in which the inside connecting portion 39 has a union structure which is capable of being connected to the city hose 30 and the outside connecting portion 40 is formed with the male screw portion 41 to which the garden connector 47 is connectable, whereby a plurality of hoses can be connected in a selected manner to one connector 33, thus being convenient and economical.

It is to be noted that the present invention is not limited to the described embodiment and many other changes and modifications may be made without departing from the scopes of the appended claims.

What is claimed is:

1. A cleaning apparatus for cleaning a cooling water passage of an outboard motor equipped with an engine in which the cooling liquid passage is formed and which is covered by an engine cover, the cleaning apparatus including a connection device to which one end of a cleaning liquid tube, which is connected at another end thereof to the cooling liquid passage of the engine, is connected and a cleaning liquid hose is connectable to the connection device from an external side thereof, said connection device comprising:

a grommet mounted to the engine cover;

a connector assembly mounted to the grommet, said connector assembly having a double-tube structure including an inside connecting portion for selectively receiving a first supply tube having a first diameter and an outside connecting portion for selectively receiving a second supply tube having a second diameter smaller than the first diameter of the first supply tube; and wherein said outside connecting portion has an outer peripheral portion configured for selectively engaging a cap member during a non-cleaning operation and selectively connecting the second supply tube to the connector assembly during a second supply tube cleaning operation, and said inside connecting portion is configured for engaging a sealing element of the cap member for sealing the cleaning liguid tube during the non-cleaning operation and has a union structure configured for being selectively connected to the first supply tube during a first supply tube cleaning operation.

2. A cleaning apparatus according to claim 1, wherein said engine cover is formed with a mounting hole to which said connection device is mounted and wherein said grommet has a cylindrical structure having openings at both end portions thereof, one of said openings being formed with an outer peripheral edge to which a peripheral groove is formed to be engaged with a peripheral edge of said mounting hole and another one of said openings being formed with an inner peripheral edge, and said connector assembly is formed with a flange portion which is fitted to said inner peripheral edge.

3. A cleaning apparatus according to claim 1, wherein said engine cover is provided with a curved portion at which said grommet is mounted.

4. A cleaning apparatus according to claim 1, wherein said connector assembly is provided with a projection extending inside the engine to which said cleaning water tube is connected.

5. A cleaning apparatus according to claim 1, wherein said cap member is detachably applied to one of the openings of the grommet so as to close an end opening of the connector assembly.

6. A cleaning apparatus according to claim 1, wherein a projection is formed to an inner surface of the engine cover at a portion below the location of the connector assembly to which said cleaning liquid tube reaches.

7. A cleaning apparatus according to claim 1, wherein said connector assembly further comprises an extension member and said connecting portion of the connector assembly is engaged with a garden hose of a size of U.S. standard through an engagement with a screw thread portion formed by the outside connecting portion.

8. A cleaning apparatus according to claim 1, wherein the union structure of the inside connecting portion is configured for receiving a side wall of the first supply tube during the first supply tube cleaning operation.

9. A cleaning apparatus according to claim 1, wherein the outside connecting portion forms a screw thread portion for selectively engaging a first complementary screw thread portion formed on the cap member during the non-cleaning operation and selectively engaging a second complementary screw thread portion formed on an extension member so as to selectively allow the second supply tube to be connected to the connector assembly during the second supply tube cleaning operation.

10. A cleaning apparatus according to claim 1, wherein the connector assembly further comprises an extension member configured for selectively engaging an outer peripheral portion of the outside connecting portion during the second supply tube cleaning operation.

11. A cleaning apparatus according to claim 10, wherein the connector assembly further comprises a second supply tube connector configured for connecting the second supply tube to the extension member.

12. A cleaning apparatus according to claim 1, wherein the cleaning liquid tube is configured to selectively pivot between a cleaning operation position where the cleaning liquid tube is connected to the connector assembly and a non-cleaning operation position where the cleaning liquid tube is connected to a projection extending from an inner wall of the engine cover.

13. An apparatus for cleaning a cooling water passage of an outboard motor covered by an engine cover, comprising:

a cleaning tube connected to the cooling water passage;

a connecting device connected to the cleaning tube;

a grommet connected to the connecting device and the engine cover;

a connector assembly connected to the grommet and having a double-tube structure including an inside connecting portion for selectively receiving a first supply tube having a first configuration and an outside connecting portion for selectively receiving a second supply tube having a second configuration smaller than the first configuration of the first supply tube; and wherein said outside connecting portion is configured for selectively receiving a seal cap member during outboard motor operation and selectively connecting the second supply tube to the connector assembly for a first selected cleaning operation, and said inside connecting portion is configured for engaging a sealing element of the seal cap member for sealing the cleaning liquid tube during outboard motor operation and for selectively receiving the first supply tube during a second selected cleaning operation.

14. The cleaning apparatus according to claim 13, wherein the engine cover defines a mounting hole for receiving the connecting device such that an edge portion of the mounting hole is fitted to an outer peripheral groove of the grommet.

15. The cleaning apparatus according to claim 13, wherein said seal cap member is detachably applied to one of a plurality of openings of the grommet so as to close an end opening of the connector assembly.

16. The cleaning apparatus according to claim 13, wherein the inside connecting portion includes an union structure configured for receiving a side wall of the first supply tube during the second selected cleaning operation.

17. The cleaning apparatus according to claim 13, wherein the outside connecting portion defines an engaging portion for selectively engaging a first complementary engaging portion formed on the seal cap member during the outboard motor operation and selectively engaging a second complementary portion formed on an extension member of the connector assembly so as to selectively allow the second supply tube to be connected to the connector assembly during the first selected cleaning operation.

18. The cleaning apparatus according to claim 17, wherein the engaging portion of the outside connecting portion comprises a male portion and the first and second complementary engaging portions comprise female portions.

19. The cleaning apparatus according to claim 13, wherein the connector assembly further comprises an extension member configured for selectively engaging an outer peripheral portion of the outside connecting portion during the first selected cleaning operation.

20. The cleaning apparatus according to claim 19, wherein the connector assembly further comprises a second supply tube connector configured for connecting the second supply tube to the extension member.

21. A cleaning apparatus according to claim 13, wherein the cleaning liquid tube is configured to selectively pivot between a cleaning position where the cleaning liquid tube is connected to the connector assembly and a non-cleaning position where a projection extending from an inner wall of the engine cover seals the cleaning liquid tube.

* * * * *